US005997335A

United States Patent [19]

Kameyama et al.

[11] Patent Number: 5,997,335

[45] Date of Patent: Dec. 7, 1999

[54] COAXIAL CABLE CONTACT

[75] Inventors: Isao Kameyama; Hiroshi Watanabe, both of Shizuoka, Japan

[73] Assignee: Yazaki Corporation, Tokyo, Japan

[21] Appl. No.: 09/098,518

[22] Filed: Jun. 17, 1998

[30] Foreign Application Priority Data

Jun. 17, 1997 [JP] Japan ..... 9-159837
Jun. 12, 1998 [JP] Japan ..... 10-165522

[51] Int. Cl.[6] ..... H01B 4/24

[52] U.S. Cl. ..... 439/394; 439/668

[58] Field of Search ..... 439/394, 578, 439/668, 675

[56] References Cited

U.S. PATENT DOCUMENTS 5,603,636 2/1997 Kanou et al. ..... 439/394

FOREIGN PATENT DOCUMENTS 55-106981 7/1980 Japan .

6-68938 3/1994 Japan .

*Primary Examiner*—M. L. Gellner
*Assistant Examiner*—Antoine Ngandjui
*Attorney, Agent, or Firm*—Morgan, Lewis & Bockius LLP

[57] ABSTRACT

A coaxial cable contact including a mounting plate having a coaxial cable mounted thereon, the coaxial cable including a central conductor, an inner insulating sheath provided around an outer circumferential surface of the central conductor, a braid wrapped around the inner insulating sheath and an outer sheath covering an outer circumferential surface of the braid. A pair of press-fitting strips is arranged on the mounting plate in a direction crossing a mounting direction of the coaxial cable. At least one pair of opposing braid clamping strips is arranged between the press-fitting strips, and a distance between the braid clamping strips is substantially equal to an outer diameter of the inner insulating sheath. Thrusting portions are respectively formed on the braid clamping strips. The thrusting portions are thrust into the braid when the coaxial cable is mounted on the mounting plate.

11 Claims, 18 Drawing Sheets

COAXIAL CABLE CONTACT

BACKGROUND OF THE INVENTION

1. Field of the Invention

This invention relates to a coaxial cable contact by which a braid of a coaxial cable can be securely connected.

The present application is based on Japanese Patent Application Nos. Hei. 9-159837 and 10-165522 which are incorporated herein by reference.

2. Description of the Related Art

Conventionally, an apparatus for electrically connecting a coaxial cable to a coaxial contact has been proposed in Unexamined Japanese Patent Publication No. Hei. 6-68938, and is shown in FIG. 23.

In the coaxial cable contact shown in FIG. 23, a central conductor 60*a* of a coaxial cable 60 is connected to one end portion of a connection terminal 61, and an outer sheath 60*d* of the coaxial cable 60 is inserted into a sleeve 62. A ferrule 63 is passed from the other end portion of the connection terminal 61, and a braid 60*c* of the coaxial cable 60 is folded in the direction opposite the connection terminal 61 as shown in FIG. 24.

Then, a dielectric insert 64 is attached to the connection terminal 61, and is inserted into the ferrule 63 as shown in FIG. 23. The sleeve 62 is moved toward the ferrule 63 to extend the braid 60*c*. The braid 60*c* is held between the sleeve 62 and the ferrule 63. A coaxial contact 65 is inserted from the other end side of the connection terminal 61 so as to accommodate the dielectric insert 64. A press-fitting strip 65*a* of the coaxial contact 65 clamps the outer circumferential surface of the sleeve 62, so that the braid 60*c* of the coaxial cable 60 is electrically connected to the coaxial contact 65. Thus, a coaxial cable contact 70 is formed.

The coaxial cable 60 is constituted by the above-mentioned central conductor 60*a*, an inner insulating sheath 60*b* provided around the outer circumferential surface of the central conductor 60*a*, the above-mentioned braid 60*c* wrapped on the outer circumferential surface of the inner insulating sheath 60*b*, and the above-mentioned outer sheath 60*d* covering the braid 60*c*.

However, there has been a problem in that it was troublesome to fold the braid 60*c* of the coaxial cable 60. In addition, when the braid 60*c* is of a low density, the braid 60*c* sometimes spread, and further, could not be controlled when an unskilled worker folded the braid 60*c*. Further, since the press-fitting strip 65*a* was clamped around the sleeve 62 by press-fitting, there has been a drawback in that heat resulting from the press-fitting caused the outer sheath 60*d* to contract and produce a gap between the outer sheath 60*d* and the braid 60*c*.

On the other hand, there has been proposed a connection terminal 170 disclosed in Unexamined Japanese Utility-Model Publication No. Sho. 55-106981, as shown in FIG. 25.

The connection terminal 170 includes a terminal body 71 having a pair of inside double lock strips 72 and a pair of outside double lock strips 73, which are respectively formed on the opposite sides of the terminal body 71. Although the inside lock strips 72 are directly formed to be erected on the opposite sides of the terminal body 71, the outside lock strips 73 are not directly erected from the opposite sides of the terminal body 71. That is, one end of a connection plate 74 is connected to one end of the terminal body 71 while the outside lock strips 73 are erected on the other end portion of the folded connection plate 74.

However, since the outside lock strips 73 are formed on the upper surface of the other end portion of the connection plate 74, it is necessary to downwardly bend the intermediate portion of the connection plate 74 toward the side that is opposite to the inside lock strips 72. Therefore, chain bands (not shown) for continuously manufacturing a plurality of connection terminals 170 cannot be formed on the connection plate 74. Accordingly, there has been a problem in that electric wires or the like (not shown) could not be press-fitted to the connection terminals 170.

SUMMARY OF THE INVENTION

In view of the above-mentioned circumstances, it is an object of the invention to provide a coaxial cable contact by which a braid of a coaxial cable can be connected easily, the reliability of the electrical connection is not reduced even if an outer sheath of the coaxial cable is deformed when the outer sheath is subjected to press-fitting, connection terminals to which coaxial cables are press-fitted can be manufactured continuously, and coaxial cables can be press-fitted continuously to the connection terminals.

According to the first aspect of the present invention, there is provided a coaxial cable contact which comprises a mounting plate having a coaxial cable mounted thereon, the coaxial cable including a central conductor, an inner insulating sheath provided around an outer circumferential surface of the central conductor, a braid wrapped around the inner insulating sheath and an outer sheath covering an outer circumferential surface of the braid. A pair of press-fitting strips is arranged on the mounting plate in a direction crossing a mounting direction of the coaxial cable. At least one pair of opposing braid clamping strips is arranged between the press-fitting strips, and a distance between the braid clamping strips is substantially equal to an outer diameter of the inner insulating sheath. Thrusting portions are respectively formed on the braid clamping strips. The thrusting portions are thrust into the braid when the coaxial cable is mounted on the mounting plate.

For example, when the exposed braid of the coaxial cable is pushed into the press-fitting strips and the braid clamping strips, the thrusting portions bite into the braid. The press-fitting strips are clamped so as to be press-fitted to the outer circumferential surface of the braid while the thrusting portions are biting into the braid. Consequently, the braid of the coaxial cable is held between both the braid clamping strips and the press-fitting strips.

According to the second aspect of the present invention, the thrusting portions are braid blades respectively formed at acute angles at free-end portions of the braid clamping strips. Accordingly, if the braid is pushed in the braid clamping strips, the braid blades securely bite into the braid.

According to the third aspect of the present invention, press-fitting blades are respectively formed at acute angles at free-end portions of the press-fitting strips, and a distance between the free-end portions of the press-fitting blades is larger than an inner diameter of the outer sheath and smaller than an outer diameter of the outer sheath. Accordingly, for example, the press-fitting blades bite in the outer sheath even when the coaxial cable is pushed into the press-fitting strips without having to expose the braid of the coaxial cable. Then, the press-fitting strips projecting from the outer sheath are clamped around the outer sheath, which has been subjected to press-fitting.

According to the fourth aspect of the present invention, a connection plate is formed at one end of the mounting plate, is bent toward the press-fitting strips, and is laid on the mounting plate. The braid clamping strips are arranged on the connection plate. Further, chain bands are arranged on the connection plate in a direction crossing a mounting direction of the coaxial cable. Accordingly, for example, if such a connection plate and chain bands are formed in each of connection terminals to which coaxial cables are respectively connected, it is possible to arrange a continuous plurality of connection terminals.

According to the fifth aspect of the present invention, the thrusting portions include: a pair of extension plates respectively continuously formed on free-end portions of the braid clamping strips, the extension plates being opposed to each other; and braid insertion blades respectively provided on first ends of the extension plates, wherein the coaxial cable is inserted between the braid and the inner insulating sheath when the coaxial cable is inserted into the braid clamping strips in an axial direction. Accordingly, the coaxial cable enters between the braid and the inner insulating sheath when the coaxial cable is inserted into the braid clamping strips in the axial direction.

According to the sixth aspect of the present invention, the braid insertion blades have a shape of Japanese Katakana "ハ" or circular arc in section, and an inner diameter defined by the braid insertion blades is set to be substantially equal to an outer diameter of the inner insulating sheath. Accordingly, the braid insertion blades separate the braid from the inner insulating sheath and turn over the braid outwardly when the coaxial cable is inserted into the braid clamping strips.

According to the seventh aspect of the present invention, the extension plates are identical in sectional shape with the braid insertion blades. Accordingly, the extension plates and the braid clamping strips can be inserted between the braid and the inner insulating sheath when the coaxial cable is inserted into the braid clamping strips.

BRIEF DESCRIPTION OF THE DRAWINGS

FIG. 5A shows a state in which the coaxial cable has not yet been connected to the two strips, FIG. 5B shows a state in which the coaxial cable has been connected to the braid clamping strips, and FIG. 5C shows a state in which the coaxial cable has been connected to the two strips;

FIG. 12A shows a state in which the coaxial cable has not yet been connected to the strips, FIG. 12B shows a state in which the strips are biting into an outer sheath, and FIG. 12C shows a state in which the outer sheath has been clamped by the press-fitting strips;

DETAILED DESCRIPTION OF THE PREFERRED EMBODIMENTS

Embodiments of the present invention will now be described with reference to FIGS. 1–22.

First Embodiment

FIGS. 1 to 10 show a first embodiment of the coaxial cable contact according to the present invention. The same strips as those in the conventional contact are referenced correspondingly, and their detailed description will be therefore omitted.

Figure 1:
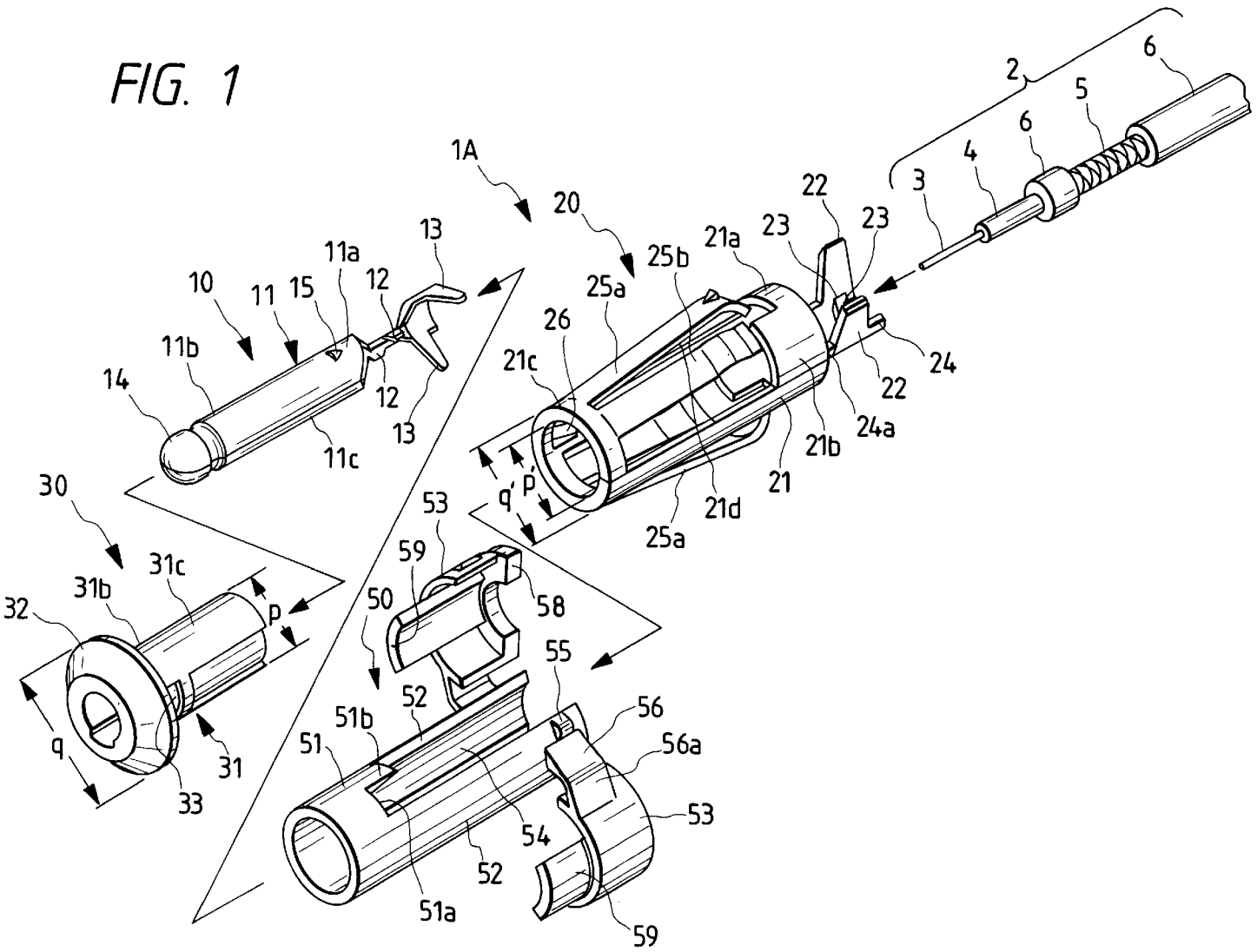
FIG. 1 is an exploded perspective view of a coaxial cable contact according to a first embodiment of the present invention.

As shown in FIG. 1, a coaxial cable contact 1A comprises a connection terminal 10, a coaxial terminal 20, an insulating member 30, and a housing 50. A central conductor 3 of a coaxial cable 2 is connected to the connection terminal 10. A braid of the coaxial cable 2 is connected to the coaxial terminal 20. The connection terminal 10 and the coaxial terminal 20 are received in the housing 50. The insulating member 30 forms an insulation between the connection terminal 10 and the coaxial terminal 20 that are received in the housing 50.

In the coaxial terminal 20, a rectangular mounting plate 24 is extended from a circumferential edge of one end side 21*a* of a cylindrical annular body 21 in an axial direction, and a pair of press-fitting strips 22 and 22 are erected on the mounting plate 24. Further, a pair of braid clamping strips 23 and 23 are provided to project between the pair of press-fitting strips 22 and 22, and a circumferential wall 21*b* of the annular body 21 is cut and raised so as to form first contact pieces 25*a* and second contact pieces 25*b* extended from the other end 21*c*. The press-fitting strips 22 and 22 are erected on free-end portions of the mounting plate 24 in the same direction. Gaps 21*d* are respectively formed between the first contact pieces 25*a* and the second contact pieces 25*b* so that the first and second contact pieces 25*a*, 25*b* do not interfere with each other. In addition, a lock piece 26 facing the one end 21*a* is cut and raised on the other end 21*c* of the annular body 21.

Figure 2:
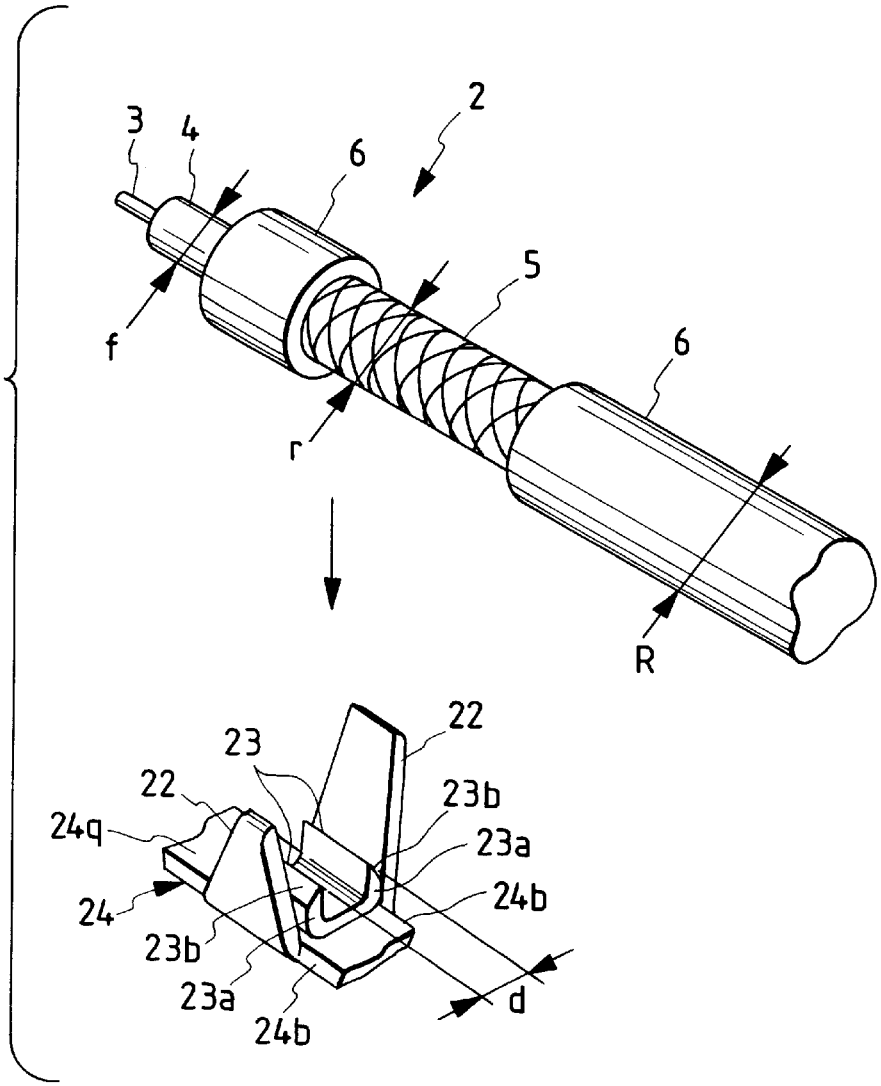
FIG. 2 is an expanded perspective view illustrating press-fitting strips and braid clamping strips of a ferrule of the coaxial cable contact illustrated in FIG. 1.
Figure 3:
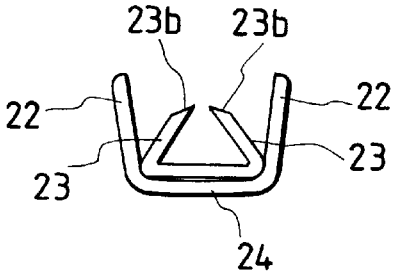
FIG. 3 shows another example of the braid clamping strips of the coaxial cable contact illustrated in FIG. 2.
Figure 4:
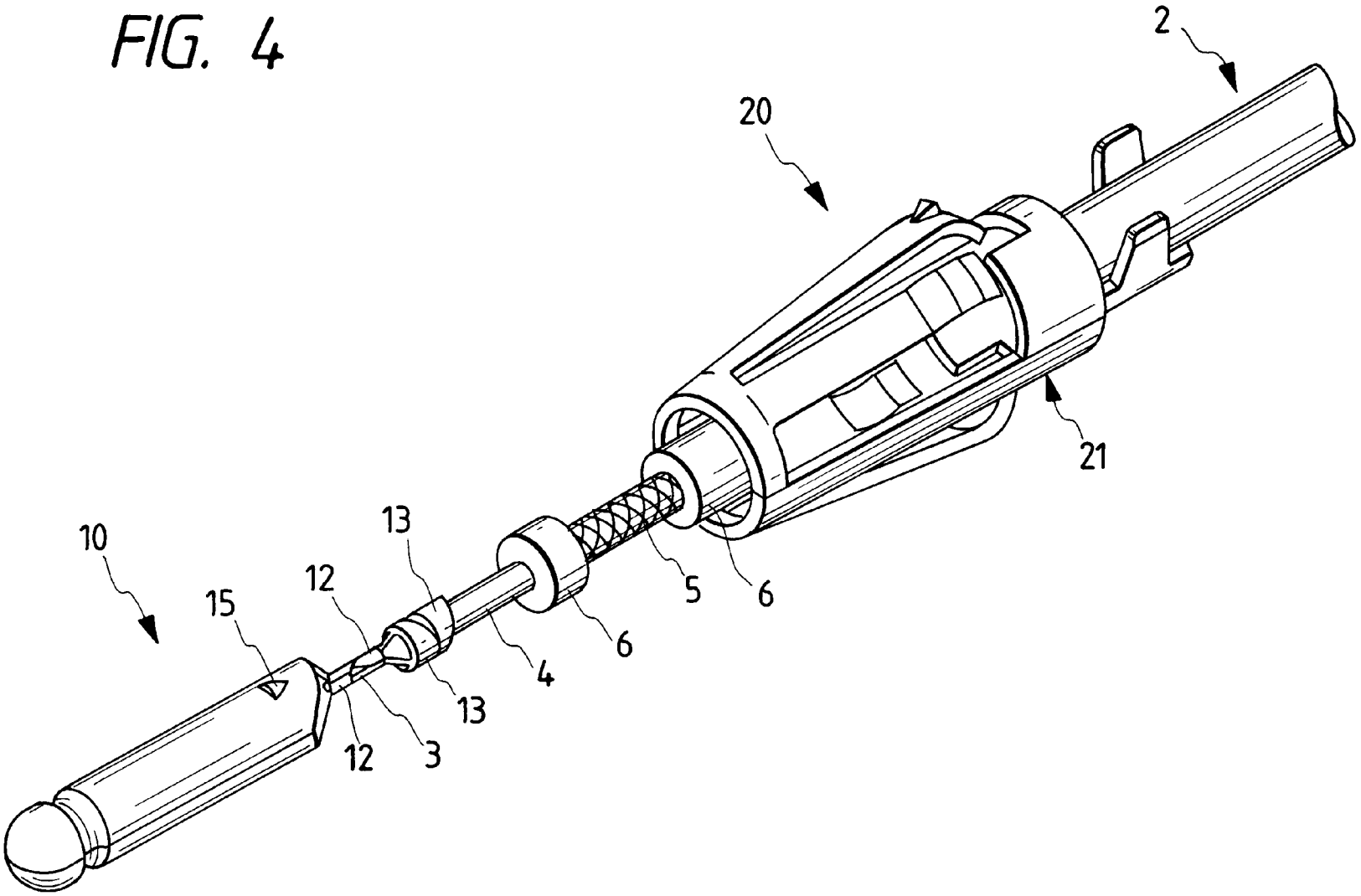
FIG. 4 shows a state in which a coaxial cable has been connected to a connection terminal.

The braid clamping strips 23 are erected from an upper surface 24*a* of the mounting plate 24 in the same direction as the press-fitting strips 22, as shown in FIG. 2. The pair of braid clamping strips 23 and 23 are opposed to each other. The height of the braid clamping strips 23 is set to be lower than that of the press-fitting strips 22. In addition, free-end portions 23*a* of the braid clamping strips 23 are cut at an acute angle (i.e., like a slope) from the outer side of the braid clamping strips 23 to the inner side thereof, so as to form braid blades 23*b* as thrusting portions. A distance d between the free-end portions 23*a* is set to be equal to or smaller than the diameter f of an inner insulating sheath 4 of the coaxial cable 2 (see FIG. 2). That is, the condition $d \leqq f$ is established.

Accordingly, when the braid 5 of the coaxial cable 2 is inserted between the braid clamping strips 23, the braid blades 23*b* thrust into the braid 5 of the coaxial cable 2. Although only a pair of the braid clamping strips 23 is erected on the mounting plate 24 in this embodiment, pairs of braid clamping strips 23 may be provided. In addition, the braid clamping strips 23 may be disposed to be opposed to each other, or may be disposed to be shifted with respect to each other.

Returning to FIG. 1, the connection terminal 10 has a pair of conductor press-fitting strips 12 and 12 and sheath clamping strips 13 and 13 for fixing the central conductor 3 and the inner insulating sheath 4 of the coaxial cable 2 to one end 11*a* of a cylindrical terminal body 11. A pin-like electric contact portion 14 is provided at the other end 11*b* of the cylindrical terminal body 11, and engagement protrusions 15 are formed to be erected on the one end 11*a* of an intermediate portion 11*c* of the terminal body 11.

As shown in FIG. 1, the housing 50 includes a pair of flexible circumferential walls 52 and 52 respectively extending in the axial direction from circumferential edges 51*a* of a cylindrical housing body 51. A pair of covers 53 and 53, each of which is formed in a half-cylinder manner, are provided on free-end portions of the respective flexible circumferential walls 52. Connection spaces 54 for respectively accommodating the first contact pieces 25*a* and the second contact pieces 25*b* of the coaxial terminal 20 are respectively formed between the pair of flexible circumferential walls 52 and 52.

Figure 9:
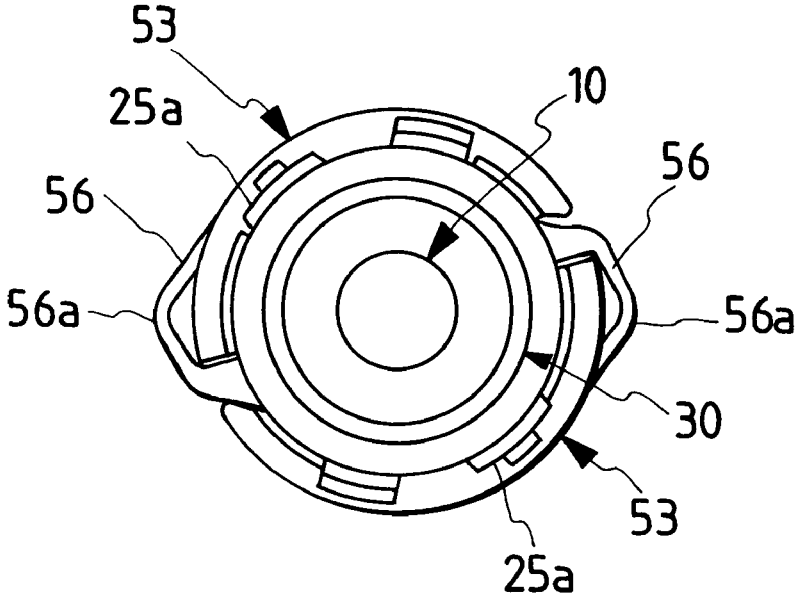
FIG. 9 shows the connection terminal and coaxial terminal of FIG. 6 when viewed in the direction of arrow A.
Figure 10:
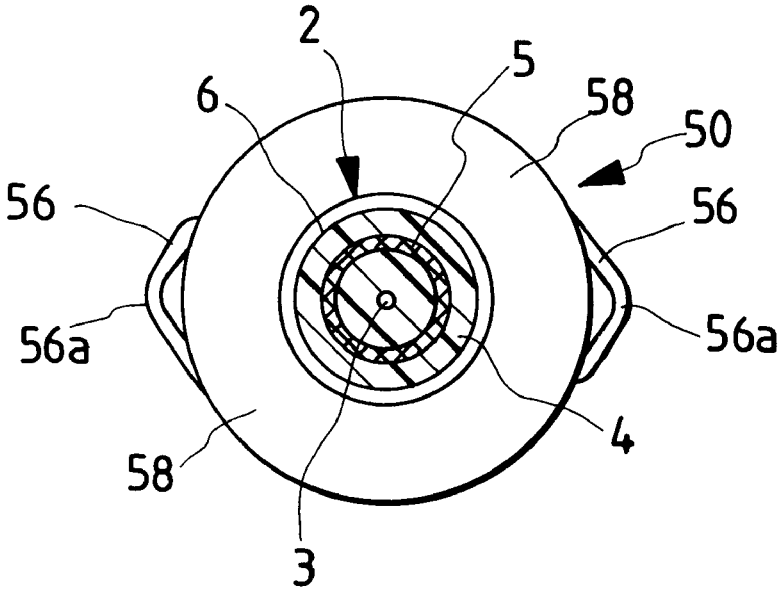
FIG. 10 shows the connection terminal and coaxial terminal of FIG. 6 when viewed in the direction of arrow B.

A prevention wall 51*b* is formed on each circumferential edge 51*a* so as to project inside the connection space 54. Each of the first contact pieces 25*a* abuts against one of the respective prevention walls 51*b* while each of the first contact pieces 25*a* enters a respective one of the connection spaces 54, so that excessive entrance of the coaxial terminal 20 is prevented. Engagement protrusions 55 are provided on the outer circumferential surface of the respective flexible circumferential walls 52. The covers 53 are respectively connected to the flexible circumferential walls 52 through V-shaped hinges 56 formed adjacent to the engagement protrusions 55 so that the covers 53 can be opened and closed. As shown in FIGS. 9 and 10, the covers 53 can be freely opened and closed in a plane perpendicular to the axis of the housing body 51.

Figure 6:
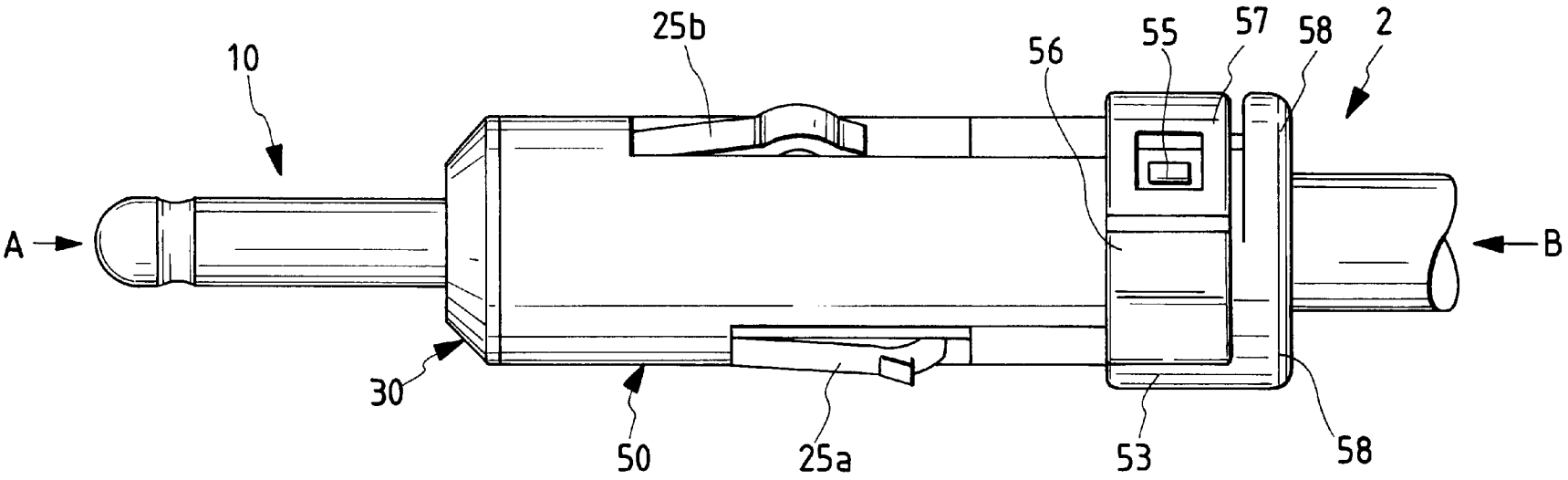
FIG. 6 shows a state in which a connection terminal and a coaxial terminal have been inserted into a housing.

As shown in FIG. 6, an engagement frame 57 is formed on a free-end portion of each of the covers 53. By the engagement between the engagement protrusion 55 and the engagement frame 57, one of the covers 53 is fixed to the flexible circumferential wall 52 of the other one of the covers 53. Since the flexible circumferential wall 52 is flexed by pushing a front end portion 56*a* (see FIG. 1) of the hinge 56, the engagement between the engagement protrusion 55 and the engagement frame 57 is released. An outer sheath protection wall 58 for fixing an outer sheath 6 of the coaxial cable 2 is circularly formed at the circumferential edge on the free-end side of each of the flexible circumferential walls 52. A terminal protection wall 59 is formed on the inner surface of each of the covers 53 to extend in the axial direction of the housing body 51. The terminal protection walls 59 fix and hold the one end 21*a* of the coaxial terminal 20 when the coaxial terminal 20 is received in the housing body 51.

When the coaxial terminal 20 in which the coaxial cable 2 is fixed is accommodated in the housing 50, the first contact pieces 25*a* and the second contact pieces 25*b* of the coaxial terminal 20 are allowed to project from the respective connection spaces 54. With the respective covers 53 being swung, the engagement frames 57 are engaged with the engagement protrusions 55, respectively. At the same time, the outer sheath 6 is fixed to the outer sheath protection walls 58, and the one end side 21*a* of the coaxial terminal 20 is fixed to the terminal protection walls 59.

Figure 7:
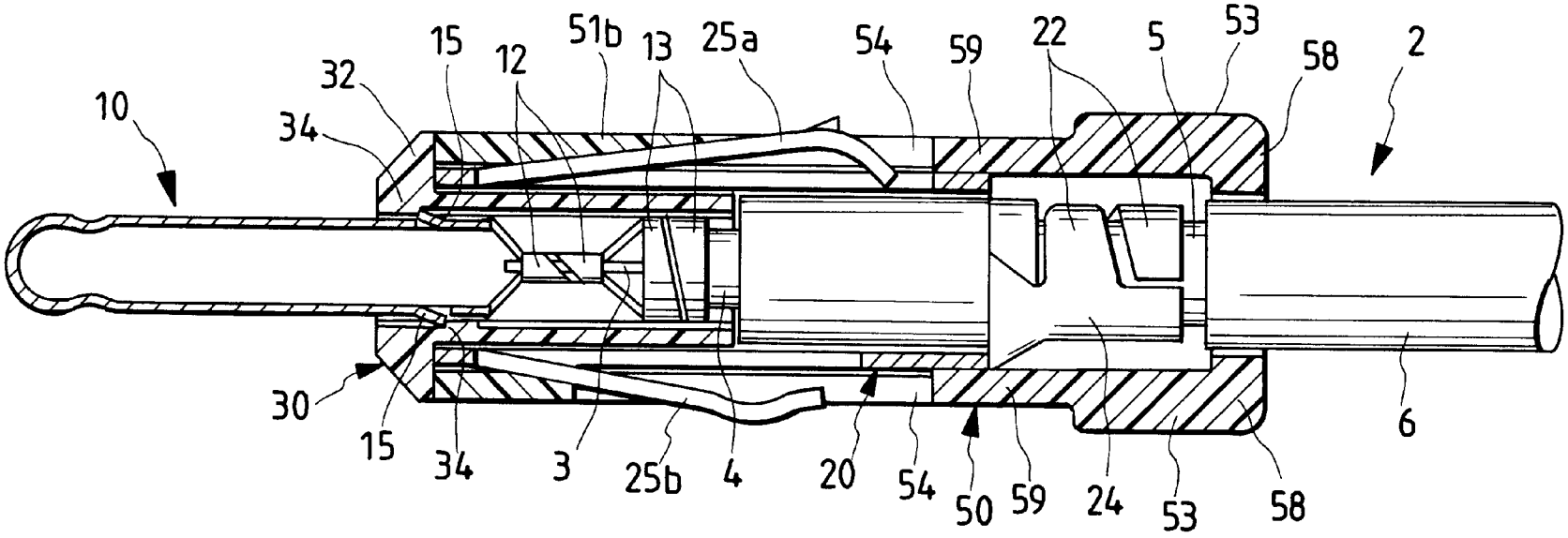
FIG. 7 is a partial sectional view illustrating an inside state of the connection terminal illustrated in FIG. 6.

As shown in FIG. 1, the insulating member 30 includes a member body 31 having a hollow cylindrical shape. A ring-like cover 32 is circularly formed on the outer surface of a circumferential wall 31*c* of the member body 31 on the other end 31*b* of the member body 31, while a pair of engagement stepped portions 34 and 34 are provided on the inner surface, as shown in FIG. 7. The outer diameter p of the member body 31 is set to be not larger than the inner diameter p' of the annular body 21 of the coaxial terminal 20 ($p \leqq p'$). The outer diameter q of the cover 32 is set to be larger than the outer diameter q' of the annular body 21 ($q > q'$). A lock hole 33 is formed in the circumferential wall 31*c* of the member body 31. This lock hole 33 is engaged with the lock piece 26 of the coaxial terminal 20. In addition, the engagement stepped portions 34 are engaged with the engagement protrusions 15 of the connection terminal 10.

Next, the method of manufacturing the coaxial cable contact 1A will be described.

First, the braid 5 and the outer sheath 6 are stripped from one end portion of the coaxial cable 2 so as to expose the inner insulating sheath 4 and the central conductor 3 as shown in FIG. 2. The outer sheath 6 is stripped from the intermediate portion of the outer sheath 6 so as to partially expose the braid 5.

Then, the coaxial cable 2 is inserted into the coaxial terminal 20. The central conductor 3 is clamped by the pair of conductor press-fitting strips 12 and 12 of the connection terminal 10, and the inner insulating sheath 4 is clamped by the pair of sheath press-fitting strips 13 and 13. After that, the coaxial cable 2 is pulled in the reverse direction.

Figure 5A:
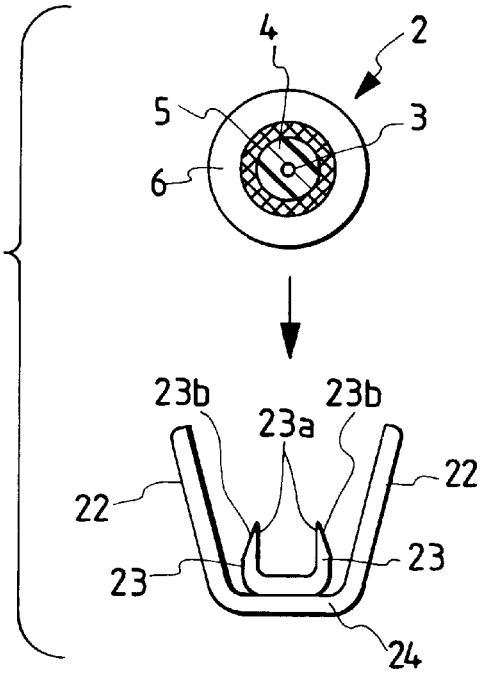
FIGS. 5A, 5B and 5C are views for explaining the case of connecting a coaxial cable to press-fitting strips and braid clamping strips.
Figure 5B:
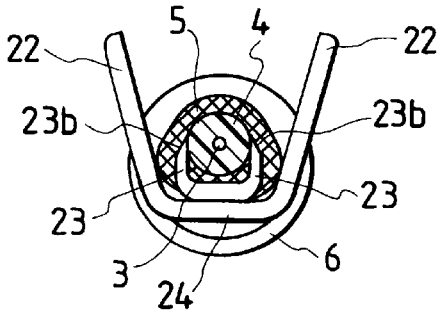
Figure 5C:
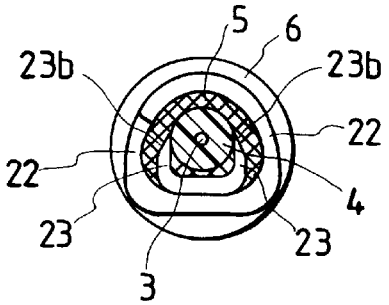

Then, when the braid 5 of the coaxial cable 2 is pushed between the braid clamping strips 23 and 23 as shown in FIG. 5A, the respective braid blades 23*b* push into and bite the braid 5 as shown in FIG. 5B. The respective braid blades 23*b* hold the inner insulating sheath 4 therebetween in a condition such that the braid blades 23*b* abut against the outer circumferential surface of the inner insulating sheath 4. That is, the respective braid blades 23*b* separate the braid 5 from the inner insulating sheath 4. As shown in FIG. 5C, the pair of press-fitting strips 22 and 22 are press-fitted to the outer circumferential surface of the braid 5, so that the pair of press-fitting strips 22 and 22 clamps the braid 5. Accordingly, the braid 5 of the coaxial cable 2 is electrically connected to the coaxial terminal 20.

Figure 8:
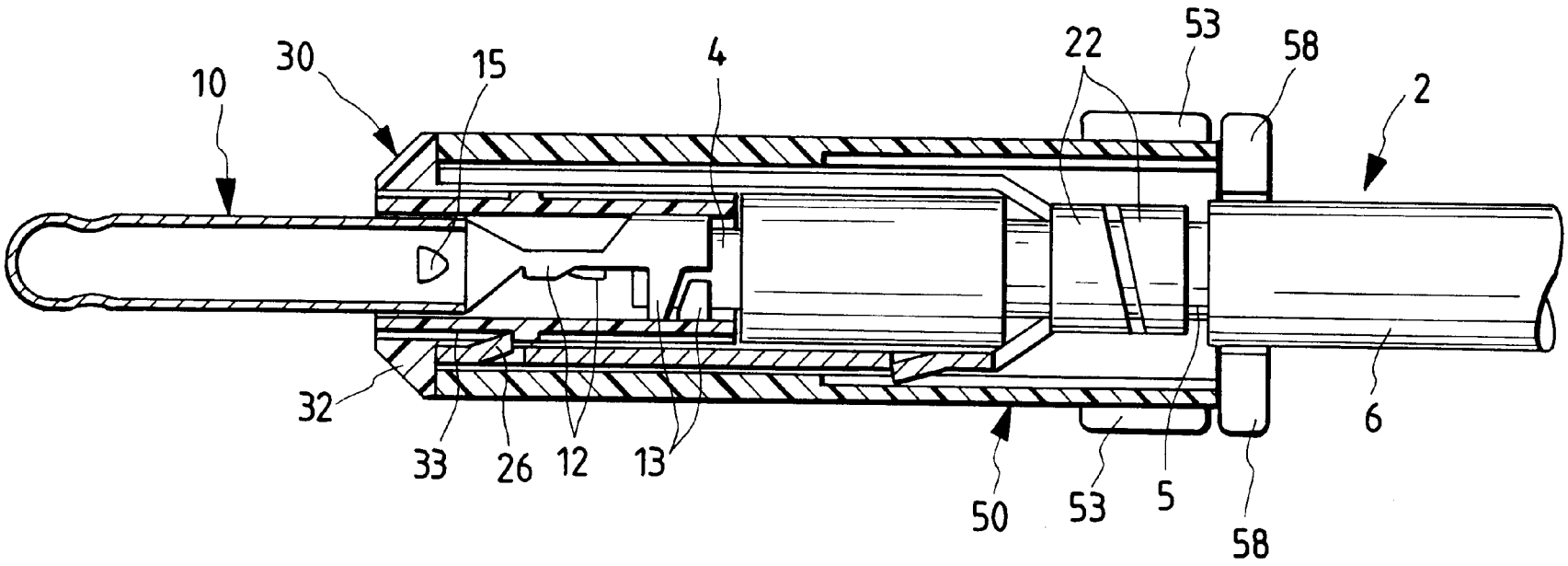
FIG. 8 shows a state in which FIG. 7 has been rotated at an angle of 90° in the axial direction.

After that, as shown in FIGS. 6 to 8, the coaxial terminal 20 is inserted into the housing 50 until the respective contact pieces 25*a* (25*b*) of the coaxial terminal 20 abut against the prevention wall 51*b*. After this insertion, the respective contact pieces 25*a* (25*b*) of the coaxial terminal 20 project from the connection space 54. After the respective covers 53 of the housing 50 are respectively rotated, the engagement frames 57 of the covers 53 are engaged with the engagement protrusions 55, respectively. In accordance with the engagement between the engagement frames 57 and the engagement protrusions 55, the one end 21*a* of the coaxial terminal 20 is held by the respective terminal protection walls 59 of the covers 53, while the outer sheath 6 of the coaxial cable 2 is held between the outer sheath protection walls 58 of the covers 53.

Finally, the insulating member 30 is inserted between the coaxial terminal 20 and the connection terminal 10 from the other end 21*c* of the coaxial terminal 20, so that the lock hole 33 of the insulating member 30 and the lock piece 26 of the coaxial terminal 20 are engaged with each other. The connection terminal 10 and the coaxial terminal are separated from each other by the insulating member 30. Thus, the coaxial cable contact 1A is formed.

As has been described above, the braid clamping strips 23 of the coaxial terminal 20 thrust into the braid 5 of the coaxial cable 2 so as to be disposed between the braid 5 and the inner insulating sheath 4. Additionally, the pair of press-fitting strips 22 and 22 is clamped around the outer circumferential surface of the braid 5. Accordingly, the braid 5 is fixed to the coaxial terminal 20 such that the braid 5 is held between the pair of braid clamping strips 23 and 23 and the pair of press-fitting strips 22 and 22. Therefore, the strength of fixation between the coaxial cable 2 and the coaxial terminal 20 is increased in comparison with the conventional cases.

In addition, even if heat or the like, caused by press-fitting acts on the inner insulating sheath 4 of the coaxial cable 2, deforms the inner insulating sheath 4, the braid 5 is not negatively affected by the deformation of the inner insulating sheath 4. Therefore, the electric connection between the coaxial cable 2 and the coaxial terminal 20 is stabilized, and the reliability of the electric connection is further improved.

Modified Example

Figure 11:
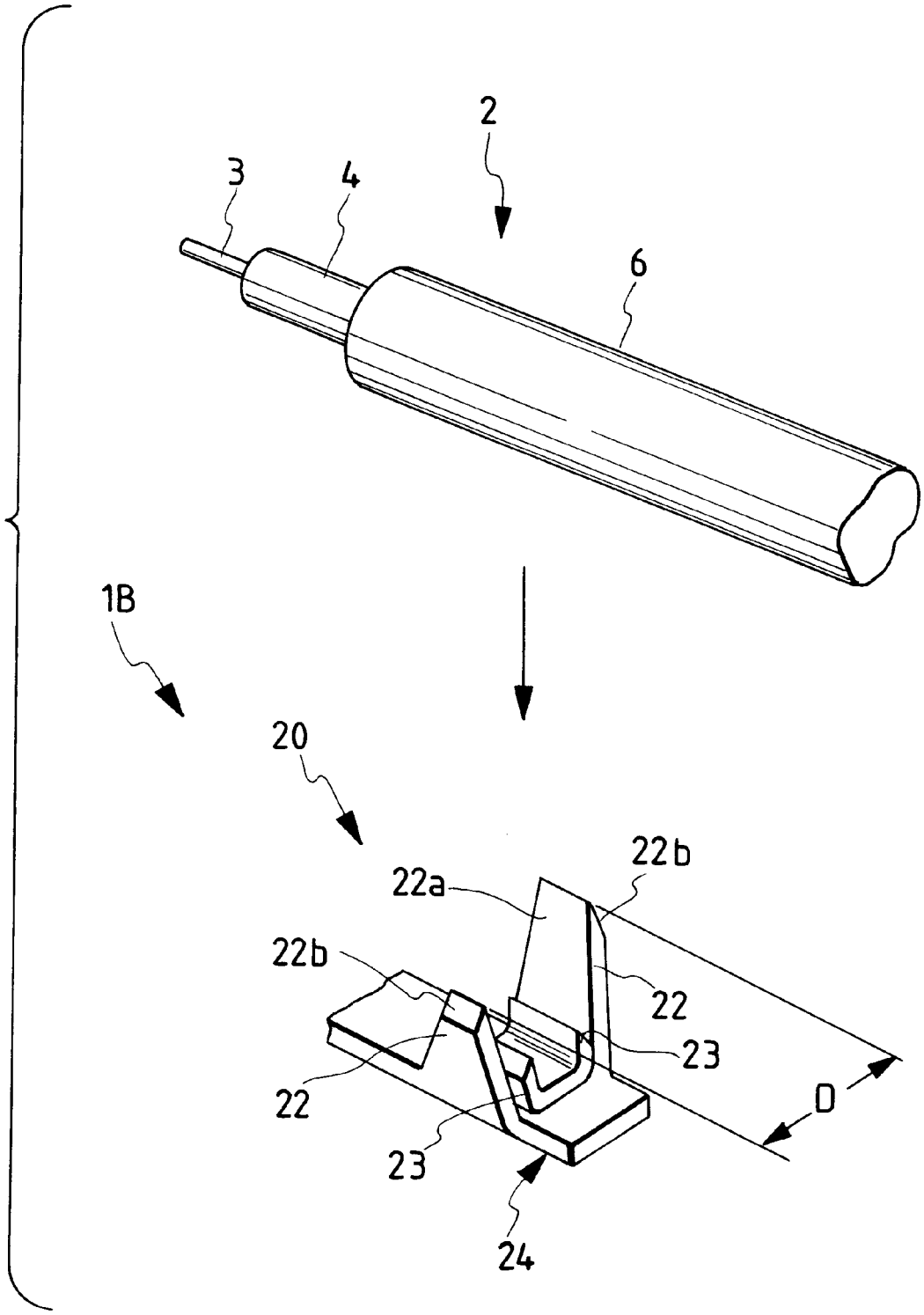
FIG. 11 shows a modification of the first embodiment of the coaxial cable contact according to the present invention.

FIGS. 11 and 12 show a modified example of the first embodiment of a coaxial cable contact according to the present invention. Constituent members that are the same as those in the first embodiment are referenced correspondingly, and their detailed description will be therefore omitted.

In the coaxial cable contact 1B of FIG. 11, press-fitting blades 22*b* are respectively formed on a pair of press-fitting strips 22 and 22 of a coaxial terminal 20.

These press-fitting blades 22*b* are formed by cutting free-end portions 22*a* of the press-fitting strips 22 from the outside of the strips 22 toward the inside thereof (i.e., toward the opposite side). The press-fitting blades 22*b* and braid blades 23*b* are directed toward the same side. The distance D between the free-end portions 22*a* of the press-fitting strips 22 is set to be larger than the inner diameter r of an outer sheath 6 of a coaxial cable 2 and smaller than the outer diameter R (see FIG. 2). That is, $r<D<R$. Although the pair of press-fitting strips 22 are erected on the mounting plate 24 to be opposed to each other in this modification, they may be erected to be shifted with respect to each other.

In order to connect the coaxial cable 2 and the coaxial cable contact 1B, that is, in order to connect the outer sheath 6 of the coaxial cable 2 with the press-fitting strips 22 of the coaxial terminal 20, and the braid 5 of the coaxial cable 2 with the braid clamping strips 23 of the coaxial terminal 20, the central conductor 3 and the inner insulating sheath 4 of the coaxial cable 2 are exposed before they are pushed between the pair of the press-fitting strips 22 and 22 of the coaxial terminal 20 and the braid clamping strips 23 and 23. Then, the outer sheath 6 is pushed, without being stripped at its intermediate portion, between the press-fitting strips 22 and 22 and the braid clamping strips 23 and 23 (see FIG. 12A).

Figure 12A:
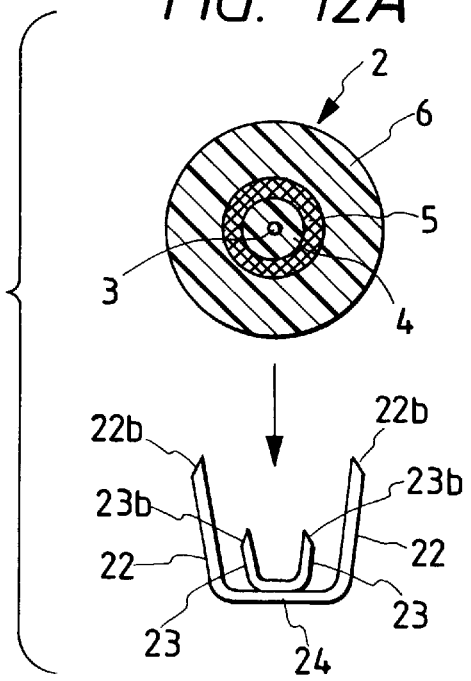
FIGS. 12A, 12B and 12C are views for explaining the case of connecting a coaxial cable to press-fitting strips and braid clamping strips.
Figure 12B:
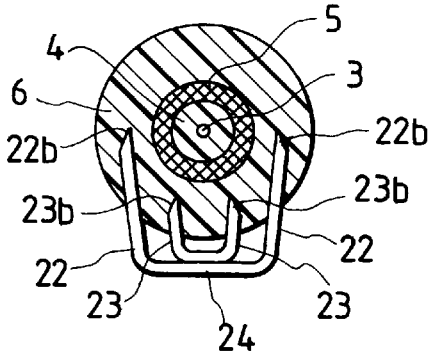
Figure 12C:
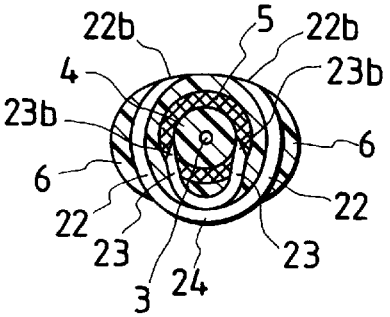

When the coaxial cable 2 is inserted, the press-fitting blades 22*b* of the press-fitting strips 22 bite into the outer sheath 6, while the braid blades 23*b* of the braid clamping strips 23 thrust into the outer sheath 6, penetrate the outer sheath 6, reach the braid 5, and then bite in the braid 5 as shown in FIG. 12B. When the coaxial cable 2 is further pushed, the press-fitting blades 22*b* project from the outer sheath 6, while the braid blades 23*b* remain in the braid 5. By clamping the press-fitting strips 22 projecting from the outer sheath 6, the free-end portions 22*a* (see FIG. 11) of the press-fitting strips 22 fix the outer circumferential surface of the outer sheath 6, as shown in FIG. 12C.

As has been described above, by forming the press-fitting blades 22*b* in the press-fitting strips 22, the press-fitting strips 22 and the braid clamping strips 23 are respectively clamped around the outer sheath 6 and the braid 5 directly without stripping the intermediate portion of the outer sheath 6. Accordingly, the additional work of stripping the intermediate portion of the outer sheath 6 can be eliminated, the coaxial cable 2 may be more efficiently electrically connected to the coaxial cable contact 1B.

Second Embodiment

Figure 13:
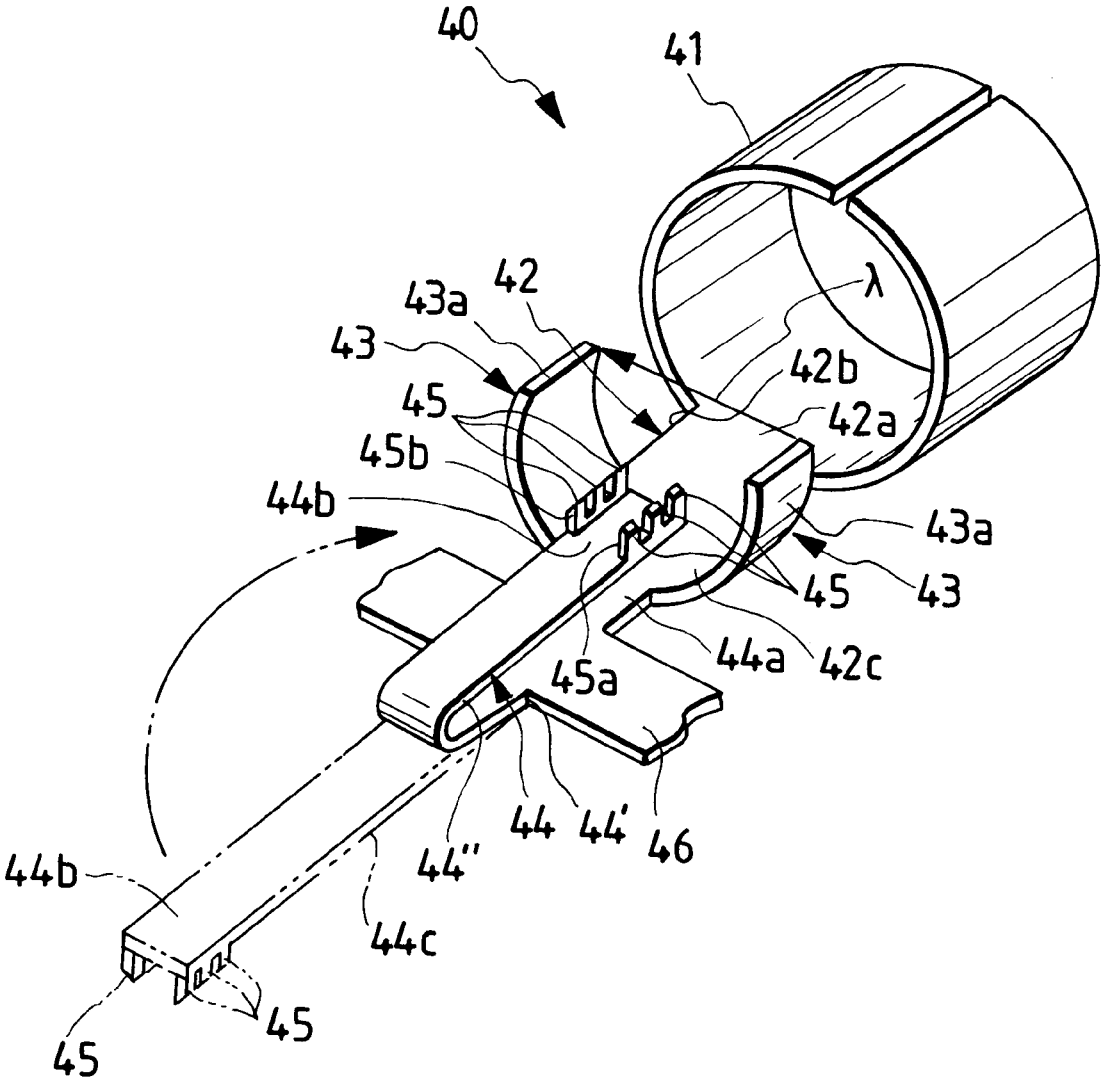
FIG. 13 is a perspective view illustrating a second embodiment of a coaxial cable contact according to the present invention.
Figure 14:
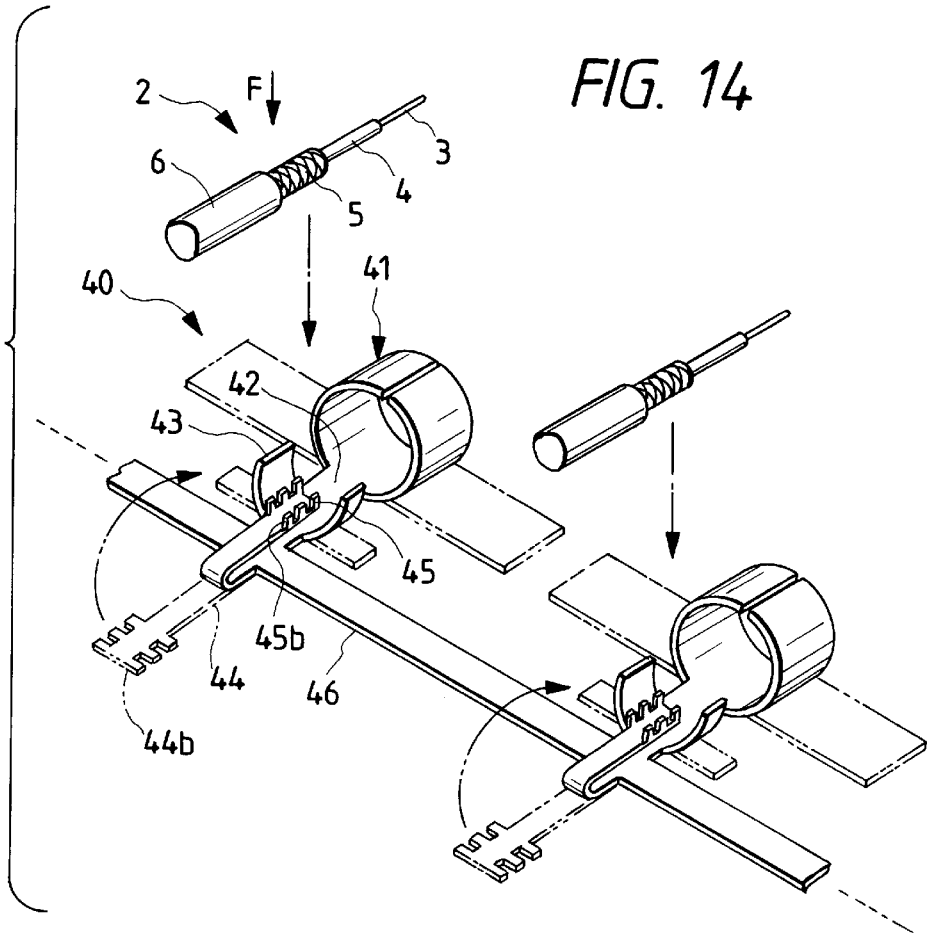
FIG. 14 shows a state in which coaxial cables have not yet been connected to a plurality of partner-side terminals connected by chain bands.
Figure 15:
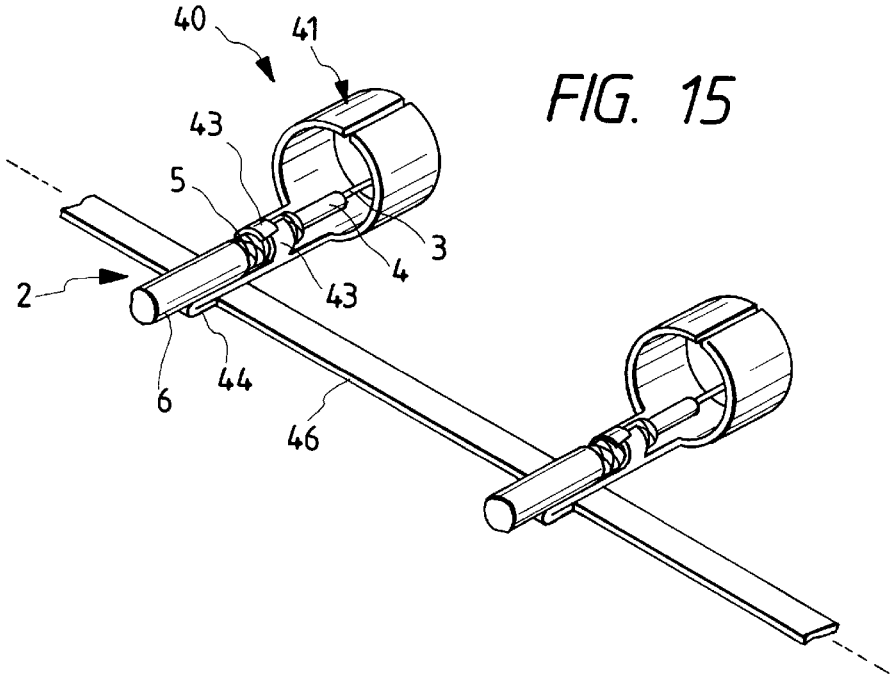
FIG. 15 shows a state in which the coaxial cables have been connected to the partner-side terminals shown in FIG. 14.

FIGS. 13 to 15 show a second embodiment of the coaxial cable contact according to the present invention. In this embodiment, a mating terminal of the connection terminal from the first embodiment will now be described.

In the mating terminal 40 of FIG. 13, one end 42*a* of a rectangular mounting plate 42 is formed continuously from a circumferential edge of a terminal body 41. The terminal body 41 has a hollow cylindrical shape. A pair of press-fitting strips 43 and 43 is erected on the widthwise opposite sides 42*b* and 42*b* of the mounting plate 42. One end 44*a* of a connection plate 44 is formed integrally with the other end 42*c* of the mounting plate 42. Three pairs of braid clamping strips 45 are formed to oppose to each other on the other end portion 44*b* of the folded connection plate 44. Chain bands 46 are formed on the widthwise opposite sides 44*c* of the connection plate 44. The terminal body 11 of the connection terminal 10 is inserted into the terminal body 41 of the mating terminal 40. The above-mentioned structure may be applied to at least one of the coaxial terminal 20 and the connection terminal 10.

The pair of press-fitting strips 43 and 43 is projected in the same direction from the opposite sides 42*b* and 42*b* of the mounting plate 42. The respective press-fitting strips 43 need not oppose each other so long as they are formed on opposite sides of the mounting plate 42. The distance $\lambda$ between free-end portions 43*a* of the press-fitting strips 43 is set to be larger than the diameter r (see FIG. 2) of the outer circumferential surface of the braid 5. That is, the condition $\lambda>r$ is established. The free-end portions 43*a* of the press-fitting strips 43 may be cut to form press-fitting blades (not shown).

The connection plate 44 is formed in a band-like manner. The other end 42*c* of the mounting plate 42 is formed integrally with the one end 44*a* of the connection plate 44. The three pairs of braid clamping strips 45 and 45 are formed on the opposite sides 44*c* of the other end portion 44*b*.

The pairs of braid clamping strips 45 and 45 are provided on the opposite sides 44*c* and 44*c* at the other end portion 44*b* of the connection plate 44 so as to extend in the direction opposite to the projecting direction of the press-fitting strips 43. Although the respective braid clamping strips 45 are disposed to be opposed to each other, they may be disposed to be shifted with respect to each other. An intermediate portion of the connection plate 44 is bent upwardly (toward the press-fitting strips 43) and thereafter folded, so that the upper surface of the other end portion 44*b* of the connection plate 44 is laid on the upper surface of the mounting plate 42. Accordingly, the press-fitting strips 43 and the braid clamping strips 45 are directed in the same direction.

Additionally, the braid clamping strips 45 are set to be shorter than the projecting length of the press-fitting strips 43. Free-end portions 45*a* of the respective braid clamping strips 45 are cut from the outside toward the inside (toward the opposite side) of the free-end portions 45*a*, to thereby form braid blades 45*b*. The distance between the free-end portions 45*a* is set to be larger than the outer diameter of the inner insulating sheath 4, but smaller than the inner diameter of the outer sheath 6.

The chain bands 46 are disposed on the opposite sides of a lower connection plate portion 44' of the folded connection plate 44. However, the chain bands 46 may be disposed on an upper connection plate portion 44" of the folded connection plate 44. With the chain bands 46 being provided on the connection plate 44 in such a manner as mentioned above, the mating terminals 40 can be manufactured continuously through the chain bands 46.

Next, the process of connecting the coaxial cable 2 to the mating terminal 40 will be described.

As shown in FIG. 14, the respective connection plates 44 of the mating terminals 40 manufactured continuously are bent and folded, so that the upper surfaces of the other end portions 44*b* of the respective connection plates 44 are laid on the upper surfaces of the mounting plates 42, and the press-fitting strips 43 and the braid clamping strips 45 are caused to be directed in the same direction. The central conductors 3, the inner insulating sheaths 4 and the braids 5 of the coaxial cables 2 are exposed in sequential order.

The central conductors 3 and the inner insulating sheaths 4 are inserted into the terminal bodies 41 so as to be free inside the terminal bodies 41. When a pressing force F is downwardly asserted on the coaxial cables 2, the braid blades 45*b* of the braid clamping strips 45 thrust into the braids 5. When the coaxial cables 2 are satisfactorily pushed into the mating terminal 40, the braid blades 45*b* remain in the braids 5 in the state where they are thrusting the braids 5. In this state, as shown in FIG. 15, the press-fitting strips 43 are press-fitted to cover the outer circumferential surfaces of the braids 5 to thereby clamp the braids 5. At the same time, a cutting tool (not-shown) cuts off the chain bands 46.

Since the coaxial cables 2 are press-fitted (i.e., clamped) to the mating terminals 40, which are manufactured continuously, the coaxial cables 2 are continuously press-fitted to the mating terminals 40. Accordingly, press-fitting according to the present invention is much more efficient in comparison with the conventional case.

Third Embodiment

A third embodiment of a coaxial cable contact according to the present invention will now be described with reference to FIGS. 16–22. Constituent members that are the same as those in the first and second embodiments are referenced correspondingly, and their detailed description will be therefore omitted.

A connection plate 47 is connected to a rear end of a mounting plate 24, the connection plate 47 is folded to form a pair of braid clamping strips 23 and 23. Furthermore, a pair of extension plates 27 and 27 are formed at the respective free-end portions of the braid clamping strips 23, the pair of extension plates 27 and 27 are bent to be opposed to each other. Furthermore, a pair of braid insertion blades 28 are formed on one ends of the respective extension plates 27. Thus, the thrusting portions of a coaxial cable contact 1C is formed.

In addition, a pair of outer sheath clamping strips 29 and 29 for clamping the outer sheath 6 are formed on the mounting plate 24 at a position behind the braid clamping strips 23.

Figure 17:
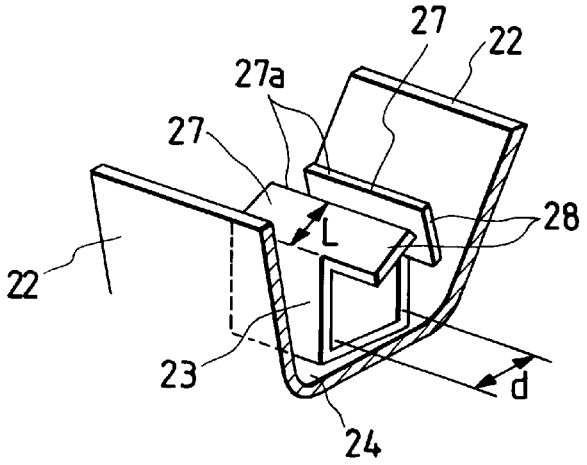
FIG. 17 is an enlarged perspective view of braid clamping strips illustrated in FIG. 16.
Figure 18:
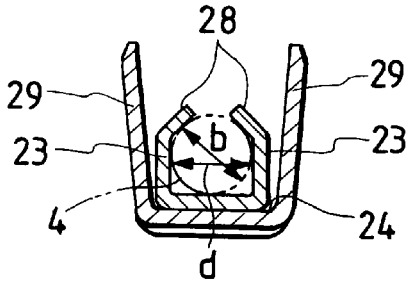
FIG. 18 is a sectional view along the line X—X in FIG. 16.

As shown in FIGS. 17 and 18, the extension plates 27 and 27 are bent so as to have a sectional shape of Japanese Katakana "ハ" or circular arc. A distance d between the braid clamping strips 23 is substantially equal to the outer diameter f of the inner insulating sheath 4 (d=f). Therefore, an inner diameter b defined by the extension plates 27 is preferably set to be substantially equal to the outer diameter f of the inner insulating sheath 4 (b=f). A length L of each of the extension plates 27 is set so that free-end portions 27*a* of the extension plates 27 do not overlap each other after the extension plates 27 are bent.

Figure 19:
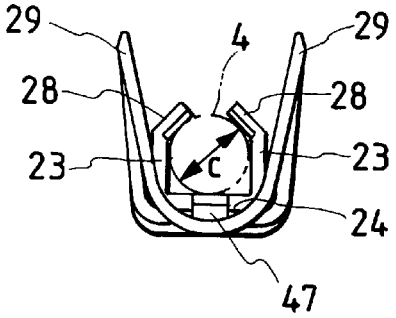
FIG. 19 shows the coaxial terminal of FIG. 16 when viewed in the direction of arrow Y.
Figure 20:
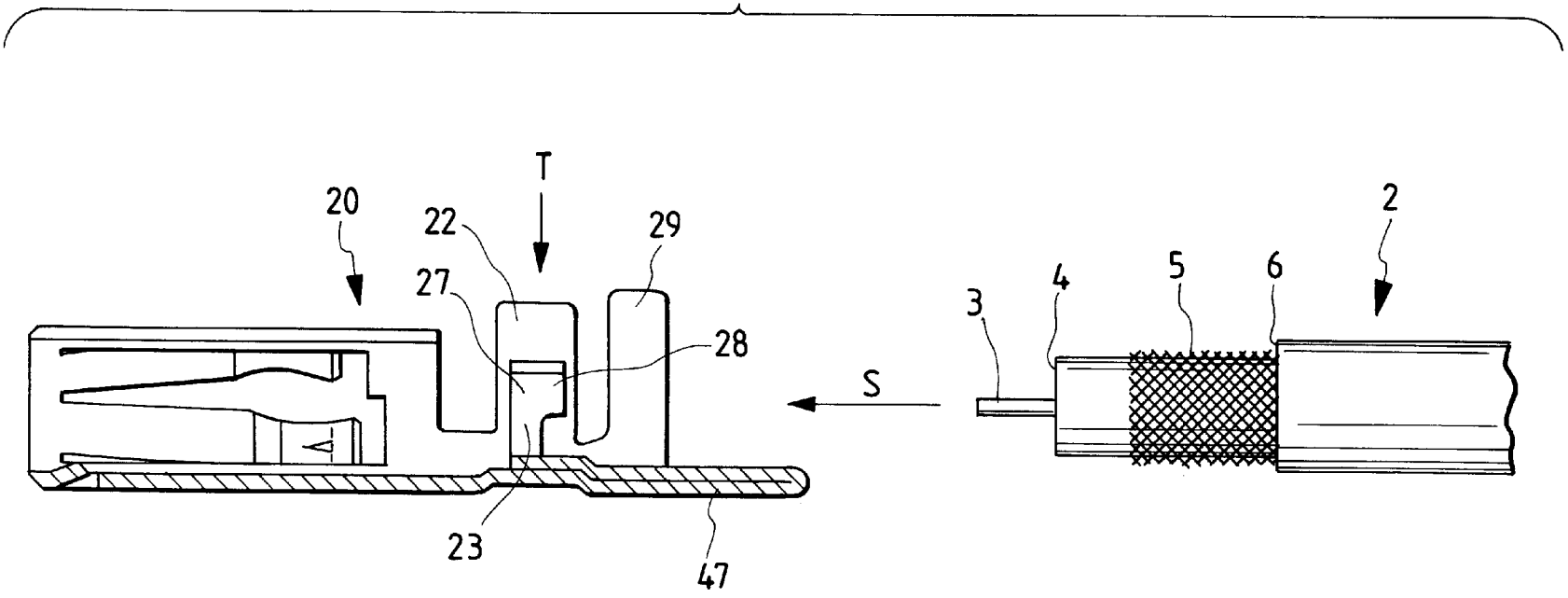
FIG. 20 shows a state before the coaxial cable is inserted into the coaxial terminal of FIG. 16.

The braid insertion blades 28 of FIG. 17 are disposed on the respective extension plates 27 so that the braid insertion blades 28 are inserted into between the braid 5 and the inner insulating sheath 4 when the coaxial cable 2 is inserted into the braid clamping strips 23 in the axial direction (direction S) as shown in FIG. 20. As shown in FIGS. 17 and 19, the braid insertion blades 28 are preferably formed to have a sectional shape of Japanese Katakana "ハ" or circular arc, and an inner diameter c defined by the braid insertion blades 28 is preferably set to be substantially equal to the outer diameter f of the inner insulating sheath 4 (c=f).

Figure 16:
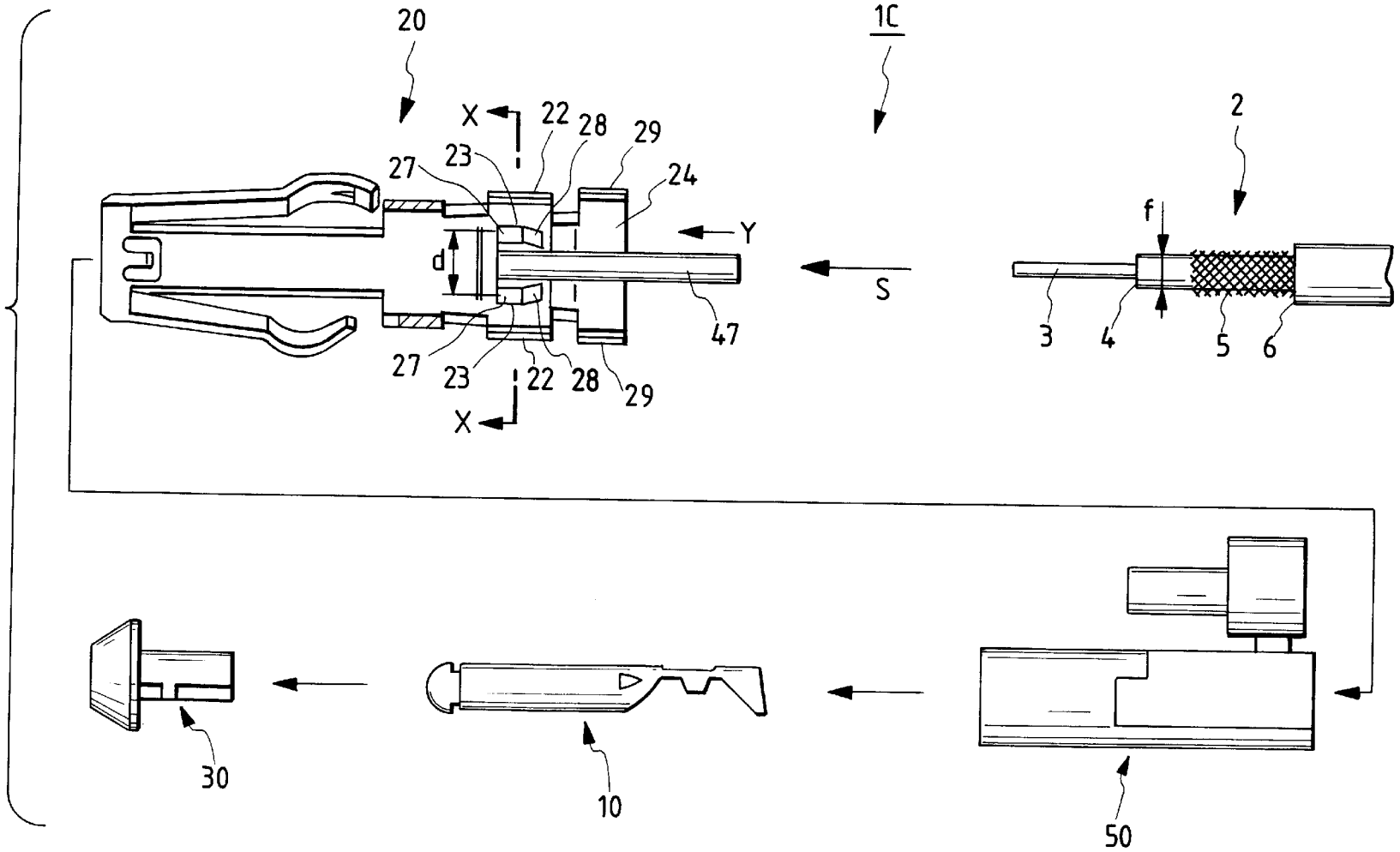
FIG. 16 shows a third embodiment of a coaxial cable contact according to the present invention.

Thus, as shown in FIG. 16, the braid insertion blades 28 are provided on the braid clamping strips 23 through the extension plates 27 and the distance d between the braid clamping strips 23 is set so as to be substantially equal to the outer diameter f of the inner insulating sheath 4, so that the coaxial cable 2 can be disposed on the mounting plate 24 when the coaxial cable 2 is inserted into the braid clamping strips 23 in the axial direction (direction S). Accordingly, positioning of the coaxial cable 2 relative to the braid clamping strips 23 is not needed, in comparison with the case of making the coaxial cable positioned on the mounting plate 24 from the above (in the direction T) with respect to the braid clamping strips 23. As a result, the disposing work of the coaxial cable 2 can be more efficiently achieved, and the reliability of the press-fitting work of the coaxial cable 2 to a coaxial terminal 20 is further increased.

Next, the method of arranging the coaxial cable 2 between the pair of braid clamping strips 23 will be described.

Figure 21:
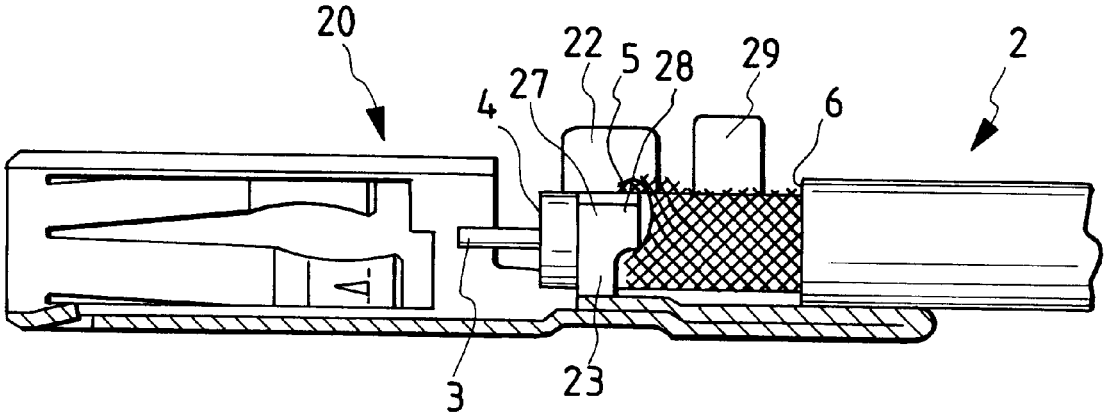
FIG. 21 shows the state where a braid is turned over by braid insertion blades in FIG. 20.

As shown in FIG. 20, the outer sheath 6 and the inner insulating sheath 4 are stripped so as to expose the braid 5 and the central conductor 3. Then, the coaxial cable 2 is inserted into the braid clamping strips 23 in the axial direction (direction S). As shown in FIG. 21, the central conductor 3 and the inner insulating sheath 4 pass through between the braid clamping strips 23.

Figure 22:
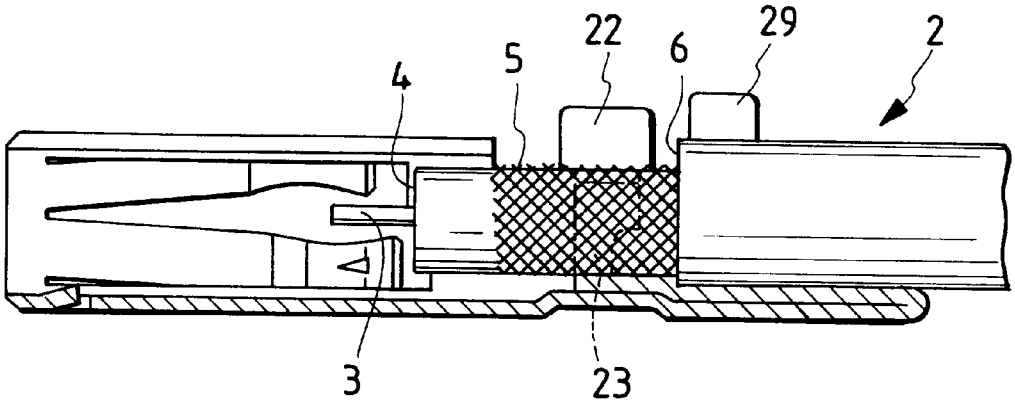
FIG. 22 shows the state where the coaxial cable is completely inserted into the braid insertion blades in FIG. 21.
Figure 23:
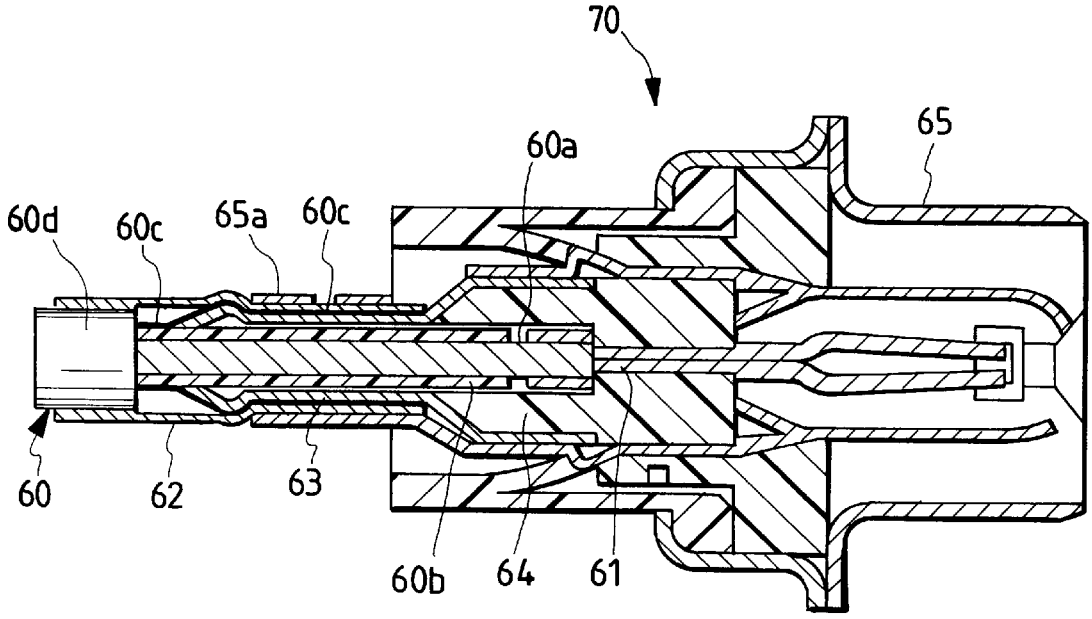
FIG. 23 PRIOR ART
FIG. 23 shows a conventional coaxial cable contact.
Figure 24:
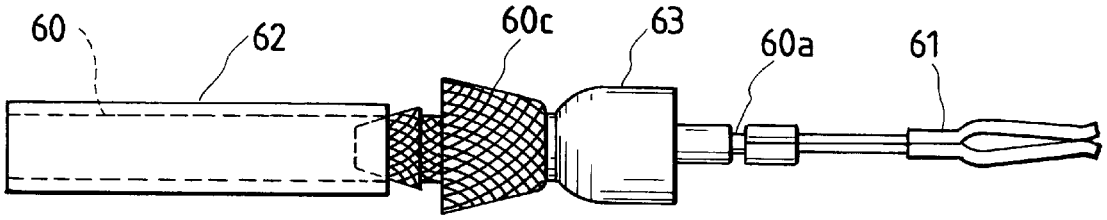
FIG. 24 PRIOR ART
FIG. 24 shows a state in which a braid of a coaxial cable in FIG. 23 has been folded.
Figure 25:
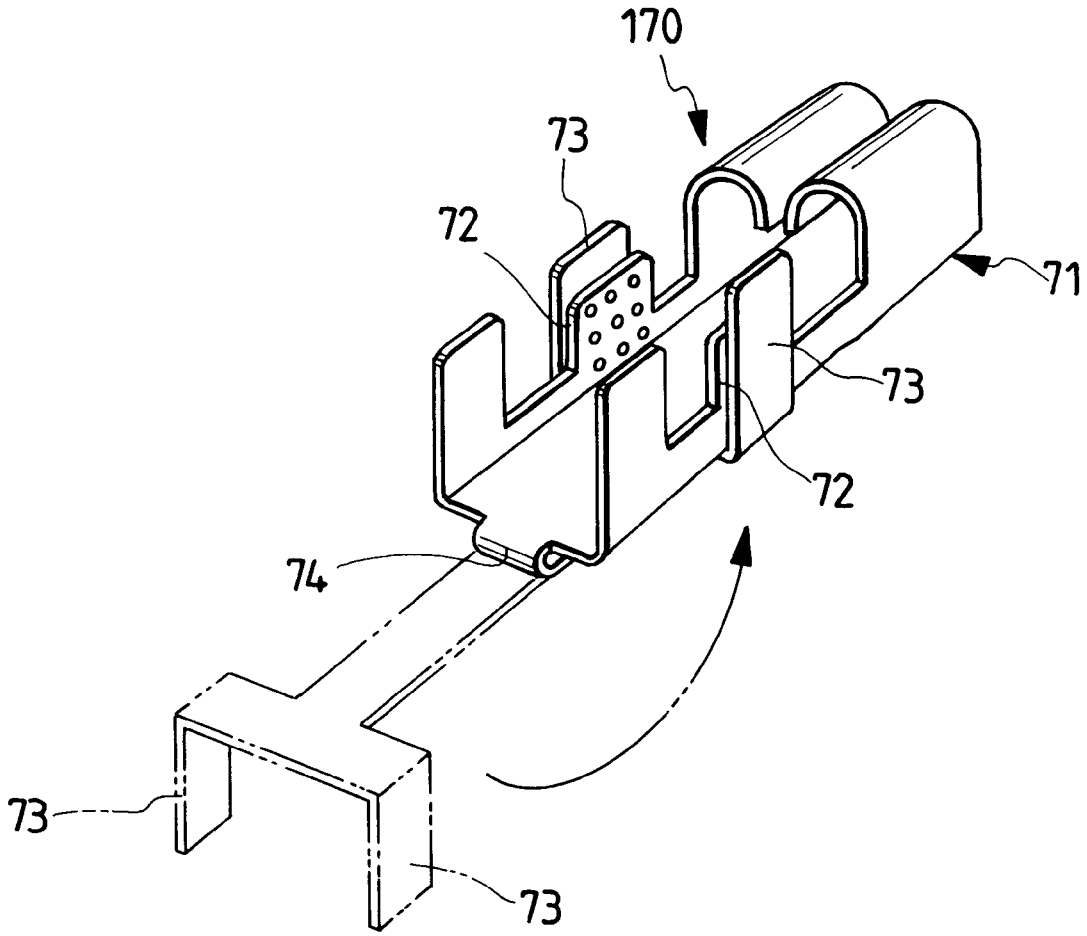
FIG. 25 PRIOR ART
FIG. 25 is a perspective view illustrating a conventional connection terminal.

Then, the braid 5 abuts against the top ends of the braid insertion blades 28 so that the braid insertion blades 28 separate the braid 5 from the inner insulating sheath 4 and turn over the braid 5 outwardly. The extension plates 27 and the braid clamping strips 23 are gradually inserted into between the turned-over braid 5 and the inner insulating sheath 4. Thus, as shown in FIG. 22, the braid clamping strips 23 can be arranged between the braid 5 and the inner insulating sheath 4. Then, the braid 5 is clamped by a pair of press-fitting strips 22 and 22 disposed outside the pair of braid clamping strips 23.

As has been described above, according to the first aspect of the present invention, for example, a coaxial cable in which a braid has been exposed is pushed between a pair of press-fitting strips formed on a mounting plate, and at least one pair of braid clamping strips formed between the pair of press-fitting strips. Then, thrusting portions formed in the braid clamping strips having a distance substantially equal to the outer diameter of an inner insulating sheath bite into the braid, and the press-fitting strips are clamped and press-fitted to the outer circumferential surface of the braid. Consequently, the braid is doubly locked. Accordingly, the braid of the coaxial cable is more forcefully fixed to the mounting plate in comparison with the conventional case.

In addition, the press-fitting strips directly clamp the braid. Therefore, in comparison with the conventional case, heat or the like generated during press-fitting has no influence on the electric connection between the press-fitting strips and the braid. Accordingly, the electric connection between the press-fitting strips and the braid is made more stable. Therefore, if the braid is exposed from the coaxial cable, the braid is securely electrically connected to the braid clamping strips. Accordingly, the reliability of the electric connection between the braid and the braid clamping strips is improved.

According to the second aspect of the invention, braid blades used as thrusting portions are formed at an acute angle in free-end portions of the braid clamping strips. Accordingly, when the braid clamping strips are pushed into the braid, the braid blades securely and automatically bite into the braid, and the braid will not separate from the braid clamping strips. As a result, clamping the braid clamping strips is more accurate and rapid as compared with the conventional case.

According to the third aspect of the invention, for example, the coaxial cable is pushed between press-fitting blades formed in free-end portions having a distance larger than the inner diameter of the outer sheath and smaller than the outer diameter thereof. Then, the press-fitting blades bite in the outer sheath, so that the press-fitting strips are securely fixed to the outer sheath. Consequently, the coaxial cable is easily and securely fixed to the press-fitting strips without exposing the braid from the coaxial cable. Accordingly, it is not necessary to expose the braid from the coaxial cable when the coaxial cable is connected to the press-fitting strips. Accordingly, the connection efficiency is improved in comparison with the conventional case.

According to the fourth aspect of the invention, braid clamping strips are disposed on a connection plate, which is provided at one end of the mounting plate. The mounting plate is bent toward the press-fitting strips, and is laid on the mounting plate. Chain bands of the connection plate are disposed so as to cross the mounting direction of the coaxial cable in a manner so that, for example, the braid clamping strips and the chain bands are provided in each of connection terminals to be respectively connected to coaxial cables. In this case, a plurality of connection terminals is continuously arranged. Consequently, the connection terminals are manufactured continuously via the chain bands, while the coaxial cables are continuously connected to the continuously manufactured connection terminals.

According to the fifth aspect of the present invention, the thrusting portions respectively include extension plates formed on braid clamping strips so as to continue thereto, and braid insertion blades respectively provided on the extension plates. Accordingly, the coaxial cable enters between the braid and the inner insulating sheath when the coaxial cable is inserted into the braid clamping strips in the axial direction. Accordingly, it is possible to save a time-consuming job for carrying out positioning of the coaxial cable relative to the braid clamping strips, in comparison with the case of making the coaxial cable positioned on the mounting plate from the above with respect to the braid clamping strips. As a result, the disposing work of the coaxial cable can be more efficiently achieved, and the reliability of the press-fitting work of the coaxial cable to a coaxial terminal is further increased.

According to the sixth aspect of the present invention, the braid insertion blades are formed so as to have a shape of Japanese Katakana "ハ" or circular arc, and the inner diameter defined by the braid insertion blades is set to be substantially equal to the outer diameter of the inner insulating sheath. Accordingly, the braid insertion blades separate the braid from the inner insulating sheath and turn over the braid outside when the coaxial cable is inserted into the braid clamping strips in the axial direction. As a result, the braid insertion blades can be surely inserted between the braid and the inner insulating sheath.

According to the seventh aspect of the present invention, the extension plates are made identical in sectional shape with the braid insertion blades. Accordingly, the extension plates and the braid clamping strips can be simply and smoothly inserted between the braid and the inner insulating sheath when the coaxial cable is pushed (inserted) into the braid clamping strips. As a result, the braid clamping strips and the braid can be surely connected to each other.

What is claimed is:

1. A coaxial cable contact, comprising:

a housing having engagement portions; and a coaxial terminal, said coaxial terminal having a cylindrical annular body with a mounting plate extended from a circumferential edge of one end of the body, and a circumferential wall of the body being cut with raised portions extending from the other end of the body, said raised portions fitting with said engagement portions when said coaxial terminal is connected with said housing, and the mounting plate having a coaxial cable mounted thereon, the coaxial cable including a central conductor, an inner insulating sheath provided around an outer circumferential surface of the central conductor, a braid wrapped around the inner insulating sheath and an outer sheath covering an outer circumferential surface of the braid;

a pair of press-fitting strips being arranged on the mounting plate in a direction crossing a mounting direction of the coaxial cable;

at least one pair of opposing braid clamping strips being arranged between the press-fitting strips and having a distance between the braid clamping strips being substantially equal to an outer diameter of the inner insulating sheath; and thrusting portions respectively formed on the braid clamping strips;

wherein said thrusting portions are thrust into the braid when the coaxial cable is mounted on said mounting plate.

2. The coaxial cable contact of claim 1, further comprising:

a connection plate being formed at one end of the mounting plate, bent toward the press-fitting strips, and laid on the mounting plate, wherein said braid clamping strips are arranged on said connection plate; and chain bands being arranged on said connection plate in a direction crossing a mounting direction of the coaxial cable.

3. The coaxial cable contact of claim 1, wherein said thrusting portions are braid blades respectively formed at acute angles at free-end portions of the braid clamping strips.

4. The coaxial cable contact of claim 1, further comprising press-fitting blades respectively formed at acute angles at free-end portions of the press-fitting strips, wherein a distance between the free-end portions of said press-fitting blades is larger than an inner diameter of the outer sheath and smaller than an outer diameter of the outer sheath.

5. The coaxial cable contact of claim 4, further comprising:

a connection plate being formed at one end of the mounting plate, bent toward the press-fitting strips, and laid on the mounting plate, wherein said braid clamping strips are arranged on said connection plate; and chain bands being arranged on said connection plate in a direction crossing a mounting direction of the coaxial cable.

6. The coaxial cable contact of claim 3, further comprising press-fitting blades respectively formed at acute angles at free-end portions of the press-fitting strips, wherein a distance between the free-end portions of said press-fitting blades is larger than an inner diameter of the outer sheath and smaller than an outer diameter of the outer sheath.

7. The coaxial cable contact of claim 6, further comprising:

a connection plate being formed at one end of the mounting plate, bent toward the press-fitting strips, and laid on the mounting plate, wherein said braid clamping strips are arranged on said connection plate; and chain bands being arranged on said connection plate in a direction crossing a mounting direction of the coaxial cable.

8. The coaxial cable contact of claim 1, wherein said thrusting portions include:

a pair of extension plates respectively continuously formed on free-end portions of said braid clamping strips, said extension plates being opposed to each other; and braid insertion blades respectively provided on first ends of said extension plates, wherein the coaxial cable is inserted between the braid and the inner insulating sheath when the coaxial cable is inserted into said braid clamping strips in an axial direction.

9. The coaxial cable contact of claim 8, wherein said extension plates are identical in sectional shape with said braid insertion blades.

10. The coaxial cable contact of claim 8, wherein said braid insertion blades have a shape of Japanese Katakana "ハ" or circular arc in section, and an inner diameter defined by said braid insertion blades is set to be substantially equal to an outer diameter of the inner insulating sheath.

11. The coaxial cable contact of claim 10, wherein said extension plates are identical in sectional shape with said braid insertion blades.

* * * * *